US005360054A

United States Patent [19]

Kaneko et al.

[11] Patent Number: 5,360,054

[45] Date of Patent: Nov. 1, 1994

[54] METHOD AND APPARATUS FOR PERFORMING HORIZONTAL CONTINUOUS CASTING

[75] Inventors: Hideo Kaneko; Hatsuyoshi Kumashiro, both of Kobe, Japan

[73] Assignee: Kawasaki Jukogyo Kabushiki Kaisha, Hyogo, Japan

[21] Appl. No.: 957,040

[22] Filed: Oct. 6, 1992

[30] Foreign Application Priority Data

Oct. 11, 1991 [JP] Japan ..... 3-292192
Sep. 3, 1992 [JP] Japan ..... 4-235485

[51] Int. Cl.[5] ..... B22D 11/12; B22D 11/128

[52] U.S. Cl. ..... 164/476; 164/417; 164/440; 164/490

[58] Field of Search ..... 164/476, 417, 490, 464, 164/465, 421, 424

[56] References Cited

U.S. PATENT DOCUMENTS 3,628,594 12/1971 Reinfeld et al. ..... 164/417
3,710,841 1/1973 Baumann ..... 164/476

FOREIGN PATENT DOCUMENTS 1558171 10/1975 Germany .
59-61559 4/1984 Japan ..... 164/448
60-54255 3/1985 Japan ..... 164/490
61-86057 5/1986 Japan ..... 164/476
61-238448 10/1986 Japan ..... 164/417
62-81255 4/1987 Japan .
62-252647 11/1987 Japan ..... 164/476
63-16834 1/1988 Japan ..... 164/464
1-54146 11/1989 Japan .

*Primary Examiner*—J. Reed Batten, Jr.
*Attorney, Agent, or Firm*—Oliff & Berridge

[57] ABSTRACT

A horizontal continuous casting apparatus comprises, in one aspect, a tundish in which a molten metal material is stored, a mold assembly connected air-tightly to the tundish for casting a round billet, and an extraction device disposed on a downstream side of the mold assembly for forming a billet having a predetermined shape from the round billet fed from the mold assembly. The extraction device comprising a plurality of formation roll units arranged along a casting direction of the round billet and the formation roll units are composed of horizontal circular roll pairs, press units for pressing the roll pairs against the round billet and drive units for driving the roll pairs.

22 Claims, 17 Drawing Sheets

METHOD AND APPARATUS FOR PERFORMING HORIZONTAL CONTINUOUS CASTING

BACKGROUND OF THE INVENTION

The present invention relates to a method and apparatus for performing horizontal continuous casting, which is capable of step-wise extracting a molten metal from a tundish, and in particular for continuously casting and molding thin plate-like billets, or such as L-shaped or H-shaped billets.

Generally, in a horizontal continuous casting apparatus, a tundish and a mold or mold assembly are air-tightly joined. Since the static pressure of a molten metal is large at the molten metal solidification starting point, it is easy to cast a billet having a circular section. In such a case it is not necessary to utilize secondary cooling water because of the large cooling effect in a mold. Thus, the space necessary for arranging an entire casting apparatus can be advantageously reduced.

In a prior art technology, such as disclosed in the Japanese Patent Publication (KOKOKU) No. 1-54146 (54146/1989), there is proposed a continuous casting method for a thin plate-like billet in which a central portion of a mold is formed to have a substantially elliptic shape. A molten metal fed into this portion from a tundish thereby casts a substantially elliptical billet. The billet thus obtained is then deformed into a plate shape in the mold.

In the described prior art, however, the feeding of the molten metal from the tundish to the mold becomes unstable in its temperature distribution and vertical cracks are likely to occur in the billet. Furthermore, the shape of the mold becomes complex, resulting in an increases machining cost. In addition, since a shell at the initial time of the solidification of the molten metal is formed in this elliptic shaped mold, defects may occur on the surface of the billet due to extraction resistance in the mold.

More specifically, the horizontal continuous casting is performed by feeding the molten metal stored in the tundish to the mold, and then cooling it to form a billet having at least a solidified outer peripheral surface portion and extracting the billet by an extraction apparatus installed on the downstream side of the mold. In such a horizontal continuous casting apparatus, the tundish and the mold are air-tightly joined as described before, so that the static pressure of the molten metal in the mold is large and there is a good contact between the mold and the solidified shell of the billet, thus being preferably applicable to a formation of a round billet. As described above, in the horizontal continuous casting method, since the tundish and the mold are air-tightly joined, there is adapted a step-wise extraction driving method having one operation cycle of "pulling→pause→push→back→pause" steps, which is different from a vertical continuous casting method in which the billet is extracted at a constant speed.

The mold utilized for such a horizontal continuous casting apparatus has a cylindrical shape and forms a billet by cooling thereby solidifying at least an outer surface of the molten metal fed into a hollow portion, i.e. cavity, of the cylindrical mold. The thickness of the solidified shell of the billet after being taken out from the mold gradually increases and the strength also increases accordingly. Therefore, a press-down process performed for molding the billet to a desired shape is performed during a stage in which the billet has a relatively thin solidified thickness and is relatively soft. Furthermore, in the continuous casting method of a high alloy steel or high carbon steel, there may occur cases in which a low melting point substance, such as carbon or sulfur, is concentrated at a casting center portion of a solidification end, resulting in the occurrence of a problem, such as breaking, at a rolling step after the continuous casting. In order to obviate this problem, segregation is prevented by discharging the concentrated low melting point substance to an upstream side by pressing it down at a point near the solidification completion (crater end).

For example, Japanese Patent Laid-Open ublication (KOKAI) No. 62-81255 (81255/1987) discloses a casting strand forging apparatus such as shown in FIG. 17, in which an anvil-type press-down device 300 is disposed on an upstream side of a billet extraction device, and the forging apparatus is installed on the ground. For this condition, the driving reaction force at the press-down formation time constitutes a load to the billet extraction device and, accordingly, it is necessary to enlarge the driving capacity of the billet extraction device. In such case, in a vertical continuous casting apparatus in which the billet is continuously cast at a constant speed, increasing the driving capacity of the extraction device does not constitute a large problem.

On the other hand, in a horizontal continuous casting apparatus in which the billet is step-wise extracted, since the solidificetion starts at a break ring end, the increasing the driving capacity of the extraction device adversely affects the quality of the billet. This is because, in a certain sense, the horizontal continuous casting apparatus generally utilizes a servo motor having a good performance, but there are few servo motors which have a good performance for large capacities. Furthermore, in the press-down device, the casting speed differs from that of the extraction device, which is a difficult problem for control, thus degrading the positioning performance and resulting in billet surface defects, i.e. cold-shut cracks are more likely. Further, the apparatus is increased in size because the apparatus is of the ground installation-type. It is difficult to maintain the accuracy of the pulling stroke and push-back stroke in the extraction device further degrading the quality of the billet.

SUMMARY OF THE INVENTION

An object of the invention is to substantially eliminate defects or longitudinal cracks encountered in the prior art and to provide a horizontal continuous casting apparatus and method capable of easily and stably manufacturing a billet having a thin plate-like shape with substantially no defects or cracks caused on the surface of the billet, the apparatus and method having a reduced power comsumption.

Another object of the invention is to provide a horizontal continuous casting apparatus capable of driving a billet extraction device at a reduced driving power and easily controlling accurate positional performance during billet formation.

These and other objects can be achieved according to the invention in one aspect by providing a horizontal continuous casting apparatus in which a tundish, in which a molten metal is stored, air tightly connected to a mold assembly for casting a round billet. The apparatus is characterized by having an extraction device disposed on a downstream side of the mold assembly for forming a billet having a predetermined shape from a round billet fed from the mold assembly and the extraction device comprises a plurality of formation roll means disposed along a casting direction of the circular billet, the formation roll means being composed of horizontal circular roll pairs, press means for pressing the roll pairs against the round billet and drive means for driving the roll pairs.

In preferred embodiments, the mold assembly has a molding capacity for casting the round, or cylindrical billet having a substantially circular cross section. The round billet fed from the mold assembly is formed by the formation roll means by step-wise extracting the round billet so as to form a billet having a predetermined thin plate-like shape. The formation roll means comprises a plurality of staged formation roll units, the formation roll units in the respective stages having horizontal circular roll pairs arranged at predetermined intervals along the casting direction of the round billet so as to oppose a direction of a diameter of the round billet being fed in a manner that the opposing width thereof is narrowed in a direction towards the downstream side of the extraction device.

The casting apparatus may further comprise a control means for controlling the predetermined intervals of the horizontal circular roll pairs so as to be adjustable and a heating device arranged at portions corresponding to end portions of the round billet to be pressed by the horizontal circular roll pairs.

The horizontal circular roll pairs are disposed at portions suitable for pressing an unsolidified portion of the round billet.

In another aspect, there is provided a horizontal continuous casting method performed using a tundish in which a molten metal is stored. A mold assembly air-tightly connected to the tundish, the method comprises the steps of feeding the molten metal to the mold assembly from the tundish, molding a billet so as to cast a round billet having a substantially circular section, and press forming a billet from the round billet cast in the mold so as to have a predetermined thin plate-like thickness, the press forming step being carried out in a plurality of stages along a round billet casting direction towards a downstream side thereof.

In these aspects, according to the invention, the molten metal is fed from the tundish to the mold assembly that is air-tightly connected thereto. As a result the temperature distribution of the molten metal can be reduced, thus reducing the defects or faults caused by the temperature distribution. The inclusion of a break ring disposed between the mold assembly and the tundish can be easily manufactured for casting the round billet having a circular section- The round billet is then formed into a billet having a thin plate-like shape after the stabilization of the physical property of the round billet by the press formation by means of a plurality of staged billet formation roll pairs disposed in the horizontal direction along the movement path of the billet. Heating is performed to the side portions of the billet at which strain is most likely caused, thus substantially eliminating the generation of cracks at these portions and also reducing the power necessary for the press formation.

In a further aspect of the invention, there is provided a horizontal continuous casting apparatus in which a tundish into which a material molten metal is stored and a mold assembly is connected air-tightly to the tundish through a break ring for casting a billet, the apparatus being characterized in that the mold assembly is mounted on the ground, an extraction device is disposed on a downstream side of the mold assembly for step-wise extracting the billet fed from the mold assembly, a bogie device is disposed to be movable on a floor along a casting direction of the billet when casting is not being performed, the bogie device being provided with a frame, a formation means being disposed in the frame of the bogie device, the extraction device being movable along the casting direction in a manner mounted on the billet, and a detecting a means being disposed for detecting a position of the bogie device moving along the casting direction.

In preferred embodiments in this aspect, the formation comprises four billet formation roll units disposed in the frame so as to completely surround the billet in all directions. Two sets of four billet formation roll units are disposed at the front and the rear portions of the frame along the billet casting direction.

The mold assembly has a molding capacity for casting billets having a substantially rectangular section and the rectangular billet fed from the mold assembly is formed by the formation roll units by intermittently extracting the rectangular billet so as to form a billet have a predetermined, thin plate-like shape.

The formation means includes a formation press comprising a press cylinder assembly.

A pair of upper and lower support rolls are respectively disposed to front and rear portions of the bogie frame and a formation press means is provided for the upper support rolls.

In this aspect of the invention, the billet formation rolls are mounted on the billet during cast formation operation, so that driving reaction at the formation operation is not applied to the extraction device as a load, thus reducing the driving power of the extraction device. Furthermore, since the cast formation rolls can be moved along the casting direction, which includes the billet extracting direction and the billet push-back direction, the operation can be performed at a predetermined position on the roller table by moving the billet formation rolls in response to the casting speed of the extraction device.

Furthermore, since the billet formation means includes the billet press means independent from the billet support rolls, the formation amount for a pressing operation can be controlled to within the allowable operating range of the press means, thus reducing the possibility of causing inner cracks in the billet through having an increased formation amount.

The nature and further characteristic features of the invention will be made clearer from the following description with reference to the accompanying drawings.

DESCRIPTION OF THE PREFERRED EMBODIMENTS

The following is a detailed description of the horizontal continuous casting appratus according to the invention with reference to the accompanying drawings.

Figure 1:
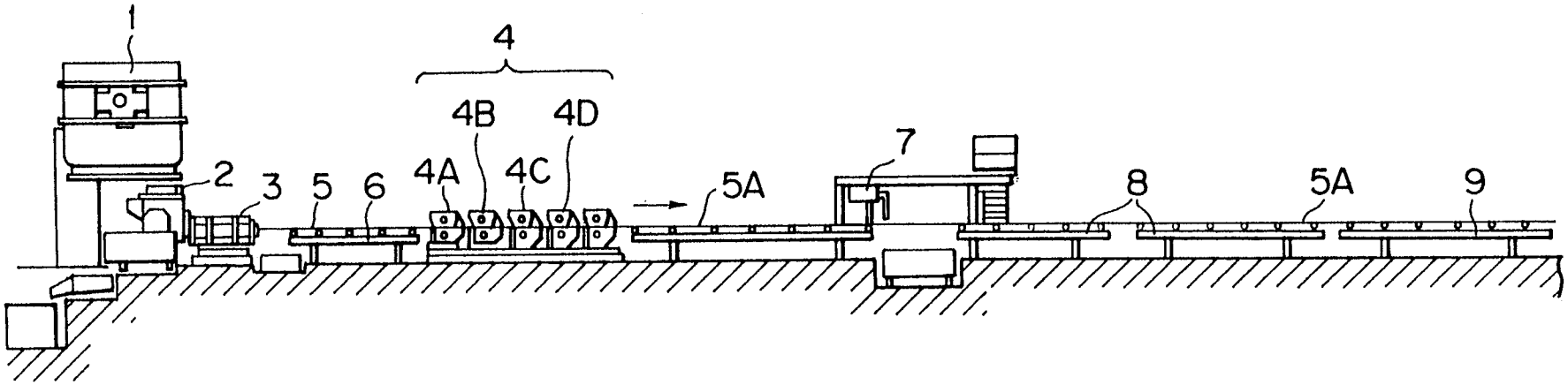
FIG. 1 is a side view showing the arrangement of a horizontal continuous casting apparatus according to one embodiment of the invention.

FIG. 1 is a view showing the structure of the horizontal continuous casting apparatus according to the invention. Reference numeral 1 denotes a ladle in which a molten metal is held. The molten metal, fed from the ladle 1, is stored in a tundish 2 disposed below the ladle 1. The tundish 2 is air-tightly joined to a mold 3 or mold assembly. The mold assembly generally comprises a break ring formed cylindrically of a ceramic material and constituting a connecting portion to the tundish 2, and a mold tube comprising a highly cooled portion and an adjustable mold portion comprising a soft cooled portion. A billet 5, having a substantially round section and fed from the mold 3 is step-wise extracted by an extraction device 4 in a horizontal direction along support rolls 6 to form the round billet 5 into a predetermined thin plate-like billet 5A. Reference numeral 7 denotes a torch-type cutter which cuts off a required length of the thin plate-like formed billet 5A after the extraction formation by means of the extraction device 4. The thin plate-like billet 5A is then fed to a cooling bed 9 after passing over a roller table 8.

Figure 2:
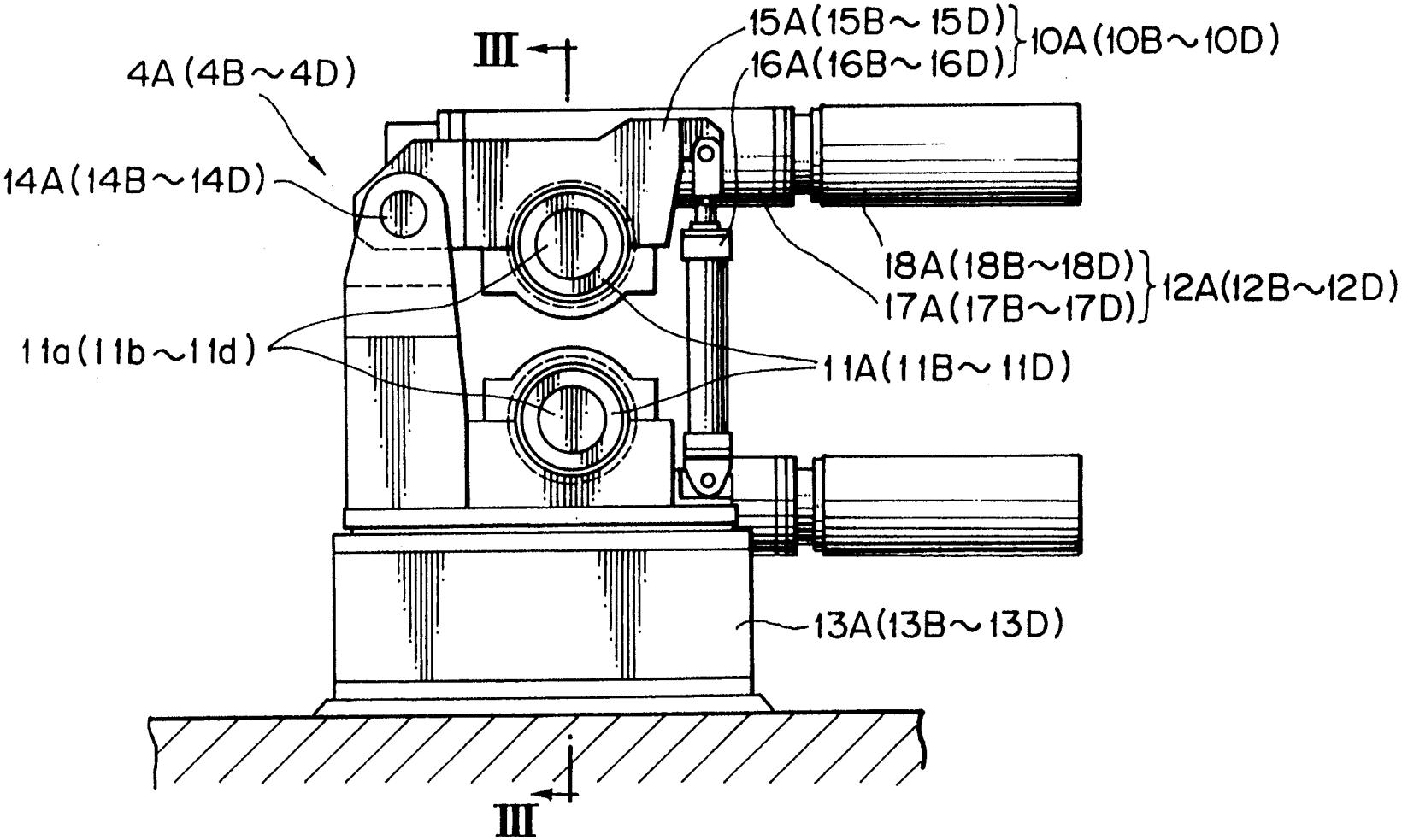
FIG. 2 is an enlarged view of billet formation roll units of an extraction device of the apparatus shown in FIG. 1.
Figure 3:
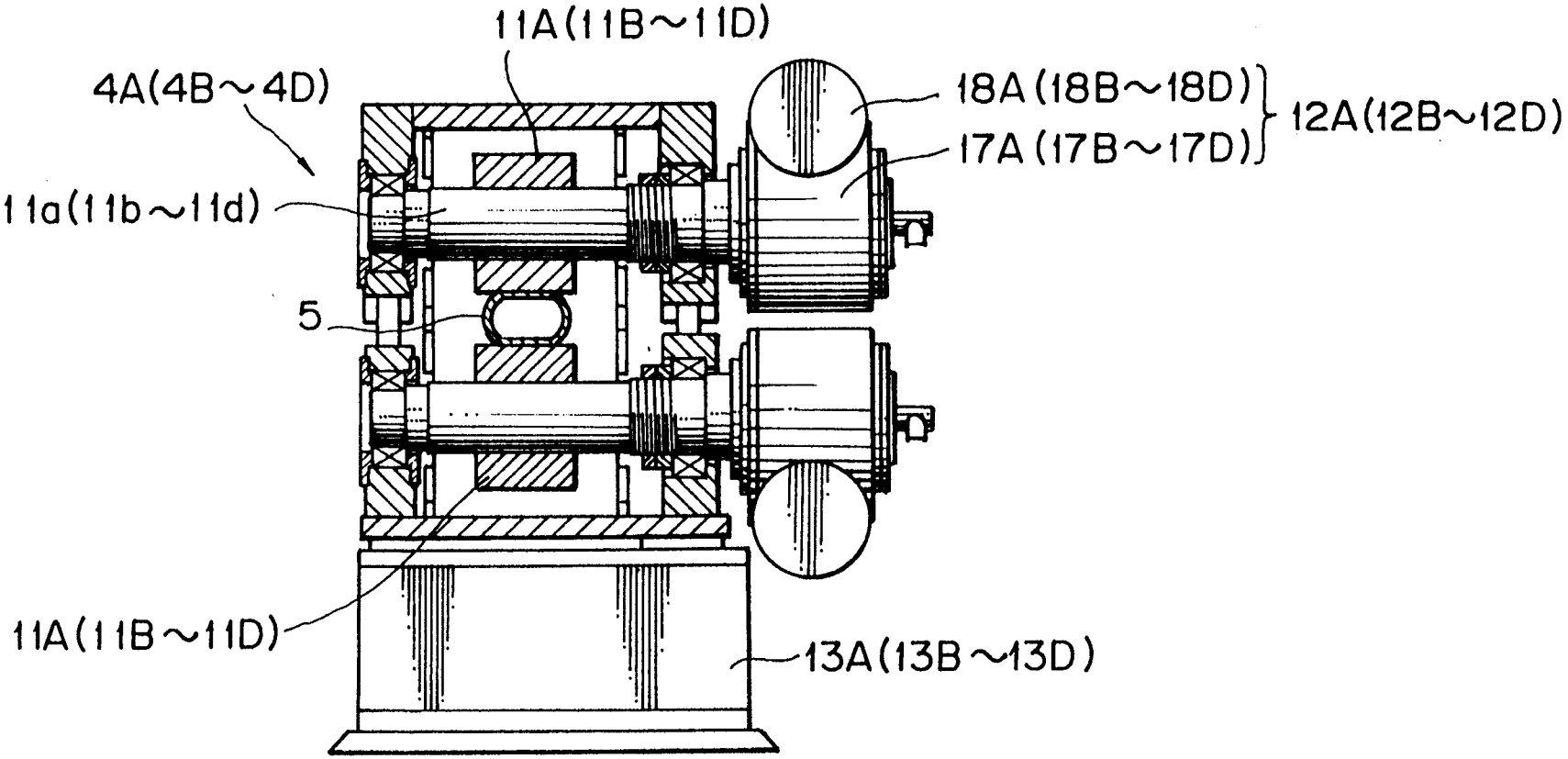
FIG. 3 is a sectional view taken along the line III—III of FIG. 2.
Figures 4A, 4B, 4C, 4D, 4E:
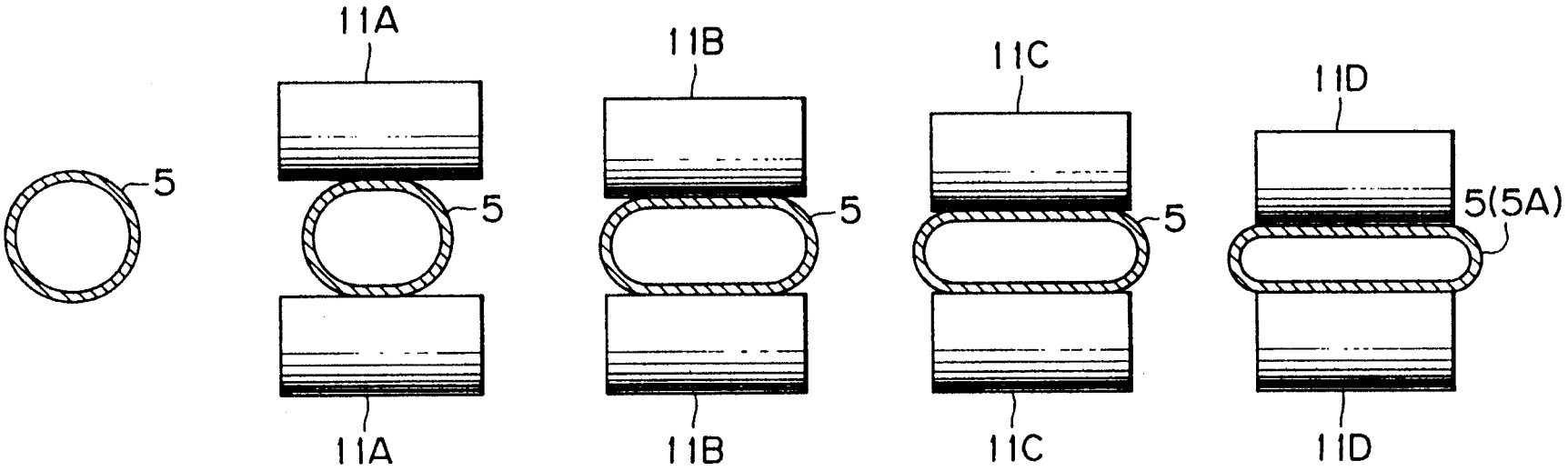
FIGS. 4A–4E are front views of four staged horizontal circular roll pairs of the billet formation unit for the explaining the billet formation steps.
Figures 5A, 5B, 5C, 5D, 5E:
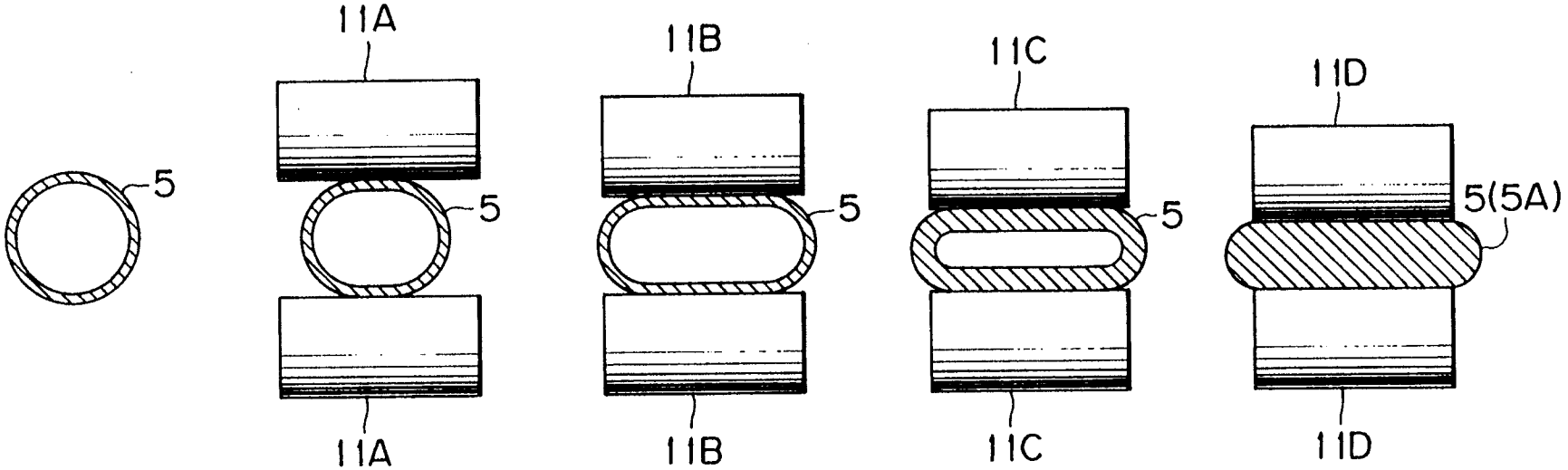
FIGS. 5A–5E are similar to that of FIGS. 4A–4E but related to another embodiment of the invention.
Figures 6A, 6B, 6C, 6D, 6E:
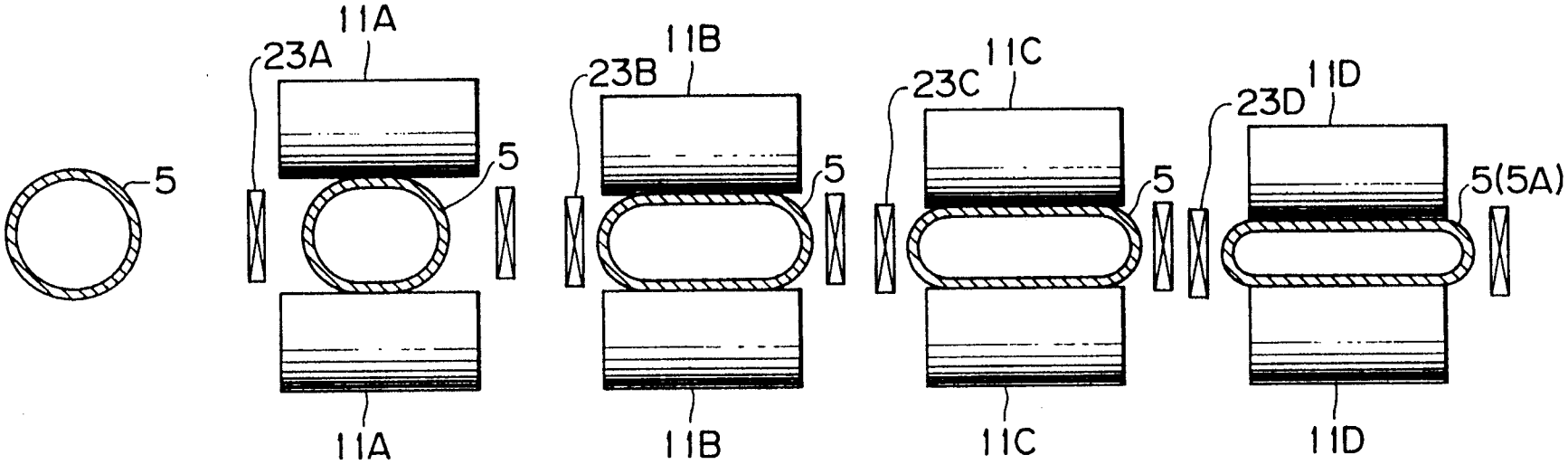
FIGS. 6A–6E are views similar to that of FIGS. 4A–4E, but related to a further embodiment of the invention.
Figures 7A, 7B, 7C, 7D, 7E, 7F:
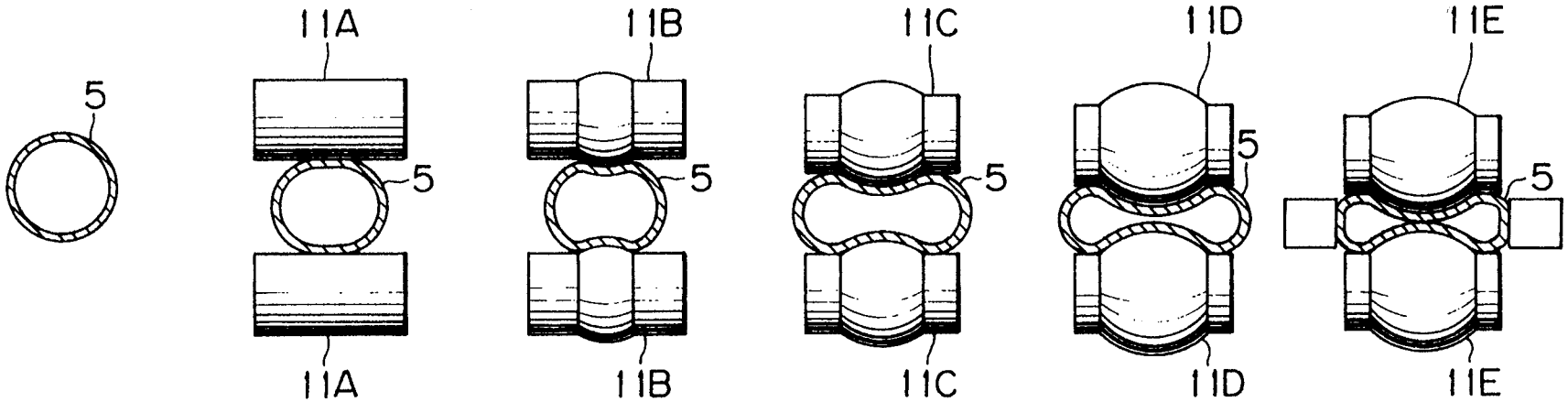
FIGS. 7A–7F and 8A–8F are views similar to those of FIGS. 4A–4E but related to still further embodiments of the invention in which an H-shaped billet and an L-shaped billet are cast, respectively.
Figures 8A, 8B, 8C, 8D, 8E, 8F:
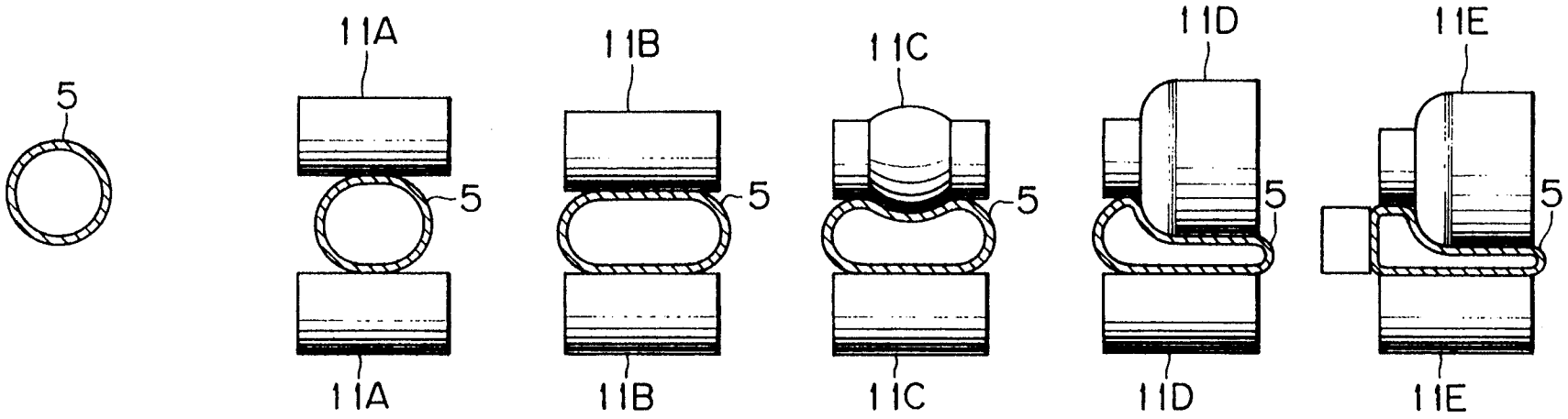

As shown in FIG. 1, the extraction device 4 is disposed on the downstream side of the mold 3 and is composed of a plurality of formation roll units, four staged roll units 4A to 4D in the illustration, with proper intervals. These four staged formation roll units 4A to 4D, as shown in FIGS. 2 and 3, are respectively composed of horizontal circular roll pairs 11A to 11D opposed in a diameter direction of the billet 5, pressing mechanisms 10A to 10D for pressing the respective roll pairs 11A to 11D against the peripheral surface of the billet 5, and driving mechanisms 12A to 12D for driving the respective roll pairs 11A to 11D and frame members 13A to 13D.

The respective pressing mechanisms 10A to 10D are composed of swing frames 15A to 15D swingably mounted around horizontal support shafts 14A to 14D with ones of the roll pairs 11A to 11D being rotatably supported and hydraulic cylinder assemblies 16A to 16D for swingably driving the swing frames 15A to 15D around the support shafts 14A to 14D, respectively. The respective driving mechanisms 12A to 12D are composed of speed reduction devices 17A to 17D mounted to one end of roll shafts 11*a* to 11*d* for respectively driving the circular roll pairs 11A to 11D and driving motors 18A to 18D directly conncted to the speed reduction devices 17A to 17D, respectively.

The four staged formation roll units 4A to 4D are arranged so that the corresponding circular roll pairs 11A to 11D press-form, an unsolidified portion of the round billet 5. Namely, they are arranged so that the press-formation can be completed before the completion of solidification portion (crater end) of the round billet 5.

The horizontal continuous casting method will be described hereunder, and is performed by the horizontal continuous casting apparatus of the structure described above.

The molten metal in the ladle 1 is stored once in the tundish 2 and then fed into the mold 3 as shown in FIG. 1. The molten metal is cooled and solidified in the mold 3 thereby molding a round billet 5 having a substantially circular section and is then step-wise extracted by the extraction device 4 in the horizontal direction along the support rolls 6. Thereafter, the round billet 5 is subjected to pressing by the four staged formation roll pairs 11A to 11D (see FIG. 2) and conveyed thereby to continuously reduce its thickness to the predetermined thickness to form an formed thin plate-like billet 5A. The thin plate-like billet 5A is then cut off by the torch-type cutter 7 so as to have a desired thickness. Thereafter, the billet 5A is fed to the cooling bed 9 through the roller table 8 and cooled there as a cast product.

In the process described above, as shown in FIG. 2, the horizontal circular roll pairs 11A to 11D of the four staged extraction roll units 4A to 4D are pressed through the pressing mechanisms 10A to 10D in the direction of the diameter of the peripheral surface of the billet passing through the extraction device 4 so that the opposing interval of each roll pair 11A (or 11B, 11C, 11D), as the billet moves downstream is narrower. The thin plate-like billet 5A is pressed and step-wise extracted in the horizontal direction through the rotation of the pressed roll pairs 11A to 11D by the actuation of the driving mechanisms 12A to 12D. At the time of the extraction, the round billet 5 is gradually deformed elliptically so as to provide an increasing diameter transverse to the pressure direction, to the thin plate-like billet 5A as shown in FIGS. 4A to 4E by the operation of the respective circular roll pairs 11A to 11D.

As described above, the mold 3 forms the billet 5 so as to have a substantially circular cross section, and after stabilizing its surface thickness and its state, the round billet 5 is formed into the thin plate-like billet 5A gradually by means of the four staged circular roll pairs 11A to 11D, so that the plate-like billet 5A having a stable state and predetermined thin thickness can be produced. Furthermore, since the formation can be completed before the completion of the solidification, extraction and formation can be done with reduced driving power, thus being advantageous.

In the described embodiment, there is described the case in which the formation by means of the roll pairs 11A to 11D of the four staged roll units 4A to 4D has been completed before the solidification of the billet 5. Formation, however, may be completed at the point at which solidification of the outer portion of the billet 5 has been further advanced, as shown in FIGS. 5A–5E. In this case, it is possible to press out the concentrated molten material remaining at the unsolidified inner portion, on the side of the tundish 2, i.e. upstream side, thus forming the thin plate-like billet 5A having fewer defects such as inner segregation.

FIGS. 6A–6E represents another embodiment according to the invention, in which heating devices 23A to 23D, such as heavy oil burners or electromagnetic induction coils, are disposed at portions corresponding to both sides of the billet 5 press-formed by the four staged circular roll pairs 11A to 11D. According to this embodiment, the generation of cracks in the side portions of the billet 5, to which the greatest stress is applied at the press formation time, can be prevented and in addition the driving power for the press formation can be reduced.

Furthermore, although the above described embodiments apply to the formation of the flat plate type steel material, the invention can be applied to the formation of an H-shaped steal material as shown in FIGS. 7A–7F or and an L-shaped steel material as shown in FIG. 8A–8F. However, in the applications directed to the H- and L-shaped steel materials, it is necessary to use at least five staged formation (deformation) roll pairs 11A to 11E manufactured for subsequently forming (deforming) the billet 5 in accordance with the shapes.

Figure 9:
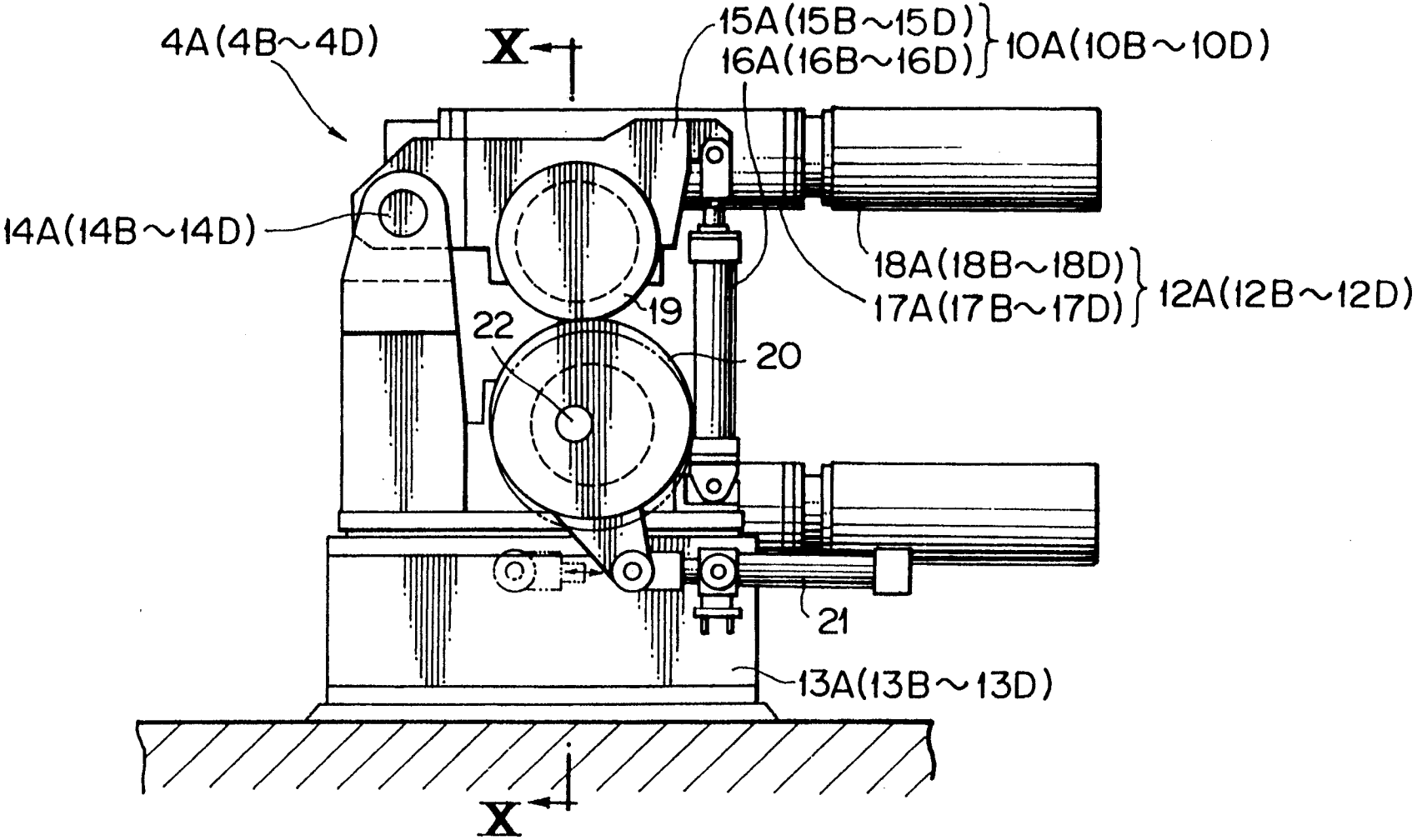
FIG. 9 is a view similar to that of FIG. 2, but related to a still further embodiment of the invention.
Figure 10:
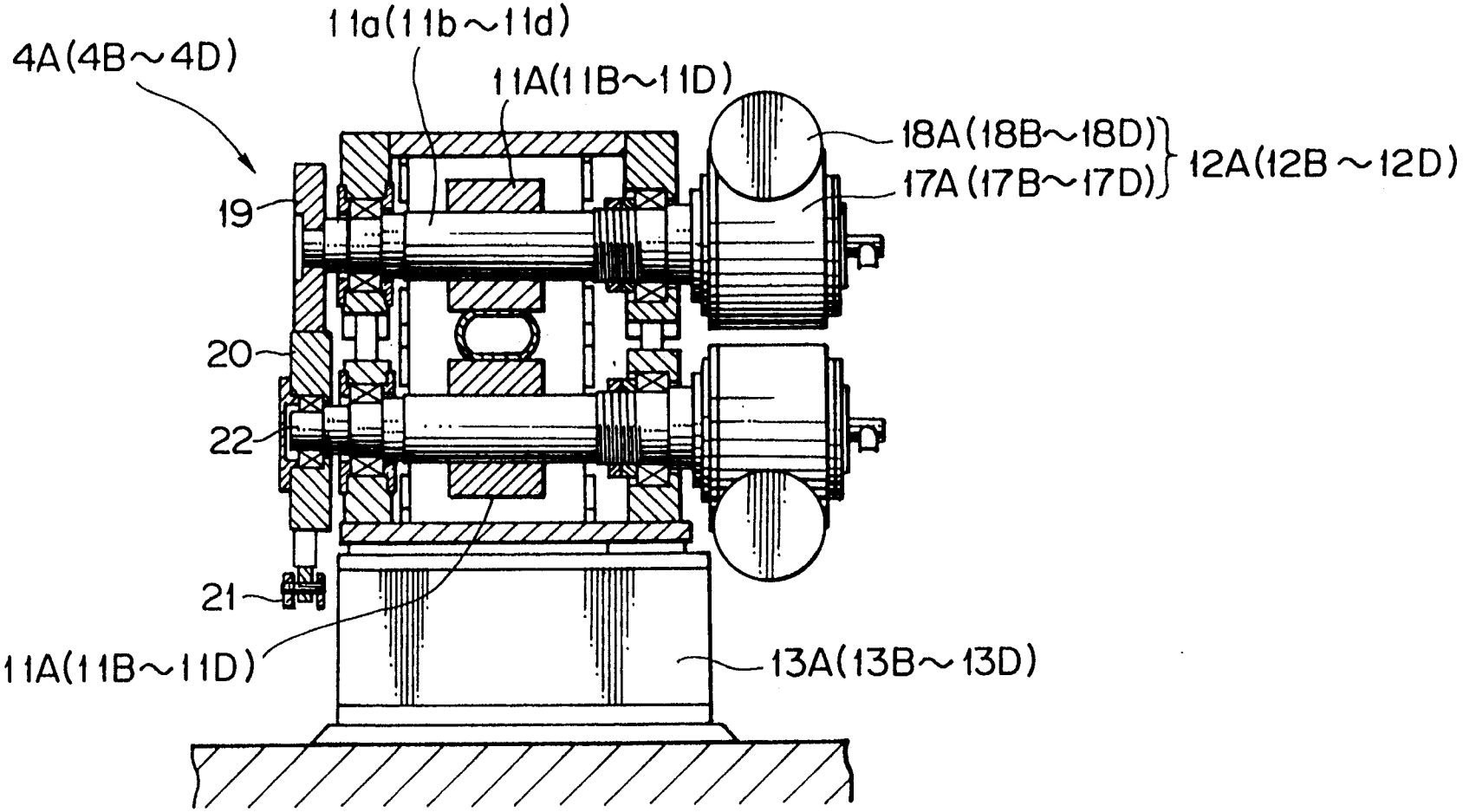
FIG. 10 is a sectional view taken along the line X—X in FIG. 9.

In the above embodiments, the respective roll pairs 11A–11D or 11E have constant intervals between the rolls. However as shown in FIGS. 9 and 10, it is possible to construct the roll pairs 11A to 11D or 11E to have adjustable intervals. Referring to FIGS. 9 and 10, reference numeral 19 denotes a roll interval stopping disc secured to one end of a roll shaft of a movable side roll and numeral 20 denotes a roll interval stopping eccentric disc secured to one end of a roll shaft of a stationary side roll. The roll interval stopping eccentric disc 20 is provided with a peripheral surface abutting against a peripheral surface of the roll interval stopping disc 19. The roll interval stopping eccentric disc 20 is rotationally displaced around an eccentric shaft 22 by a cylinder 21, and the intervals between the rolls of the respective roll pairs 11A to 11D or 11E can be adjusted through the rotational displacement of the roll interval stopping eccentric disc 20 around the eccentric shaft 22. This makes it possible to continuously cast a plurality of different kinds having billets of circular cross sections with different diameters by using an extraction formation roll unit provided with such roll interval adjusting mechanisms, that is, it is possible to use the roll interval adjusting mechanism for the manufacture of thin plate-like billets having different widths and/or thicknesses.

Figure 11:
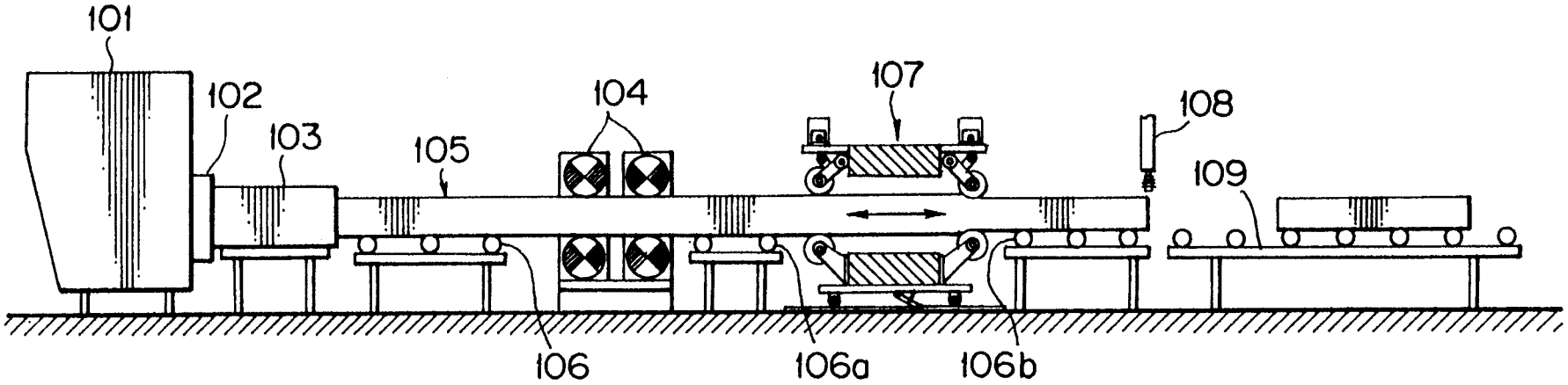
FIG. 11 is a longitudinal view showing the arrangement of in a further aspect of an embodiment of the invention.

FIG. 11 is a side view of another horizontal continuous casting apparatus that is a further embodiment according to the invention.

Referring to FIG. 11, reference numeral 101 denotes a tundish to which a mold 103 or mold assembly is air-tightly connected through a break ring 102. An extraction device 104 is disposed on the downstream side of the mold 3 for step-wise extracting a billet 105 having a substantially rectangular section fed from the mold in a horizontal direction along support rolls 106.

A billet forming device 107 is disposed on the downstream side of the extraction device 104. A billet 05 formed by the billet forming device 107 is cut by a cutter 108 so as to have a predetermined length, and the thus cut billet 105 is conveyed to a cooling bed (not shown), via a roller table 109. In FIG. 11, a right-pointing arrow shows the pulling direction due to the extraction device 104 and a left-pointing arrow shows a push-back direction of the billet 105. With reference to the following drawings, the meaning of these arrows are the same as those described above, and the term "casting direction" includes billet pulling direction and billet push-back direction.

Figure 12:
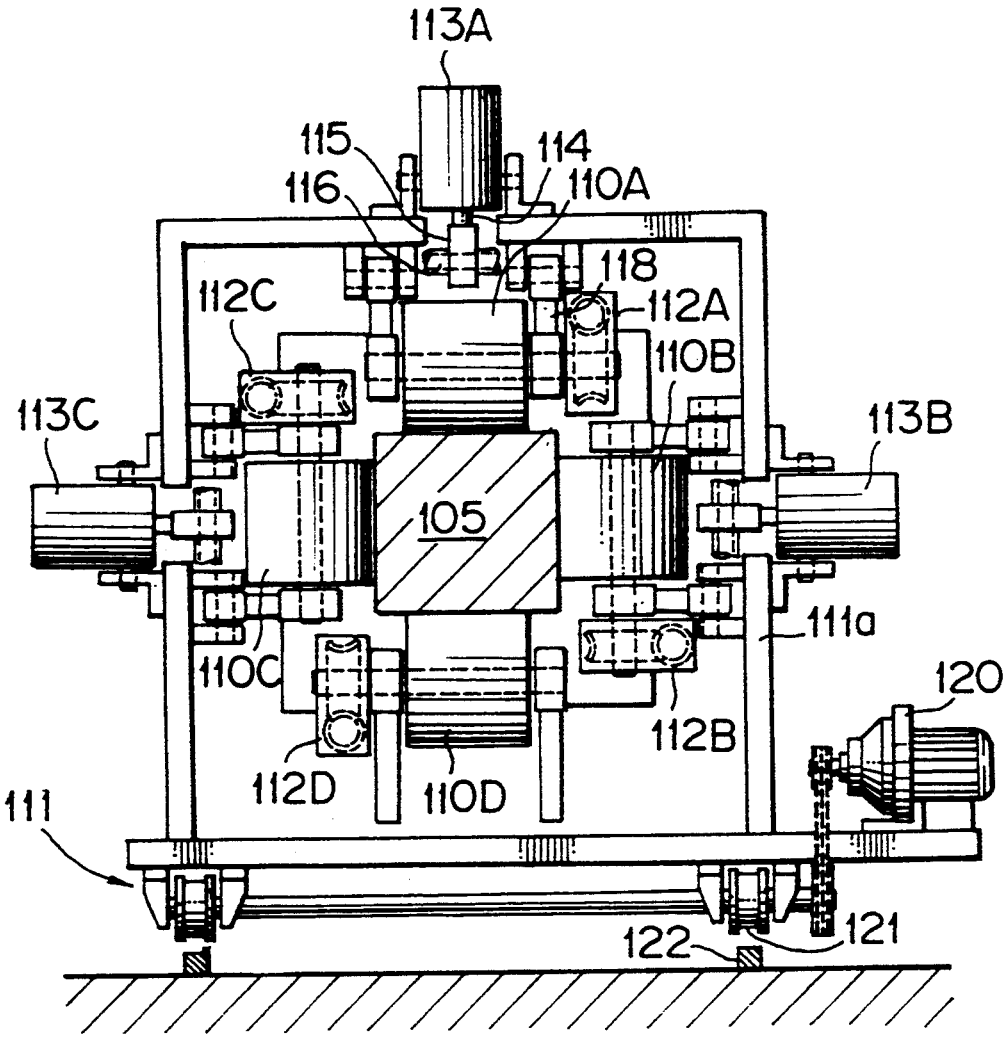
FIG. 12 is a front view of a billet formation device of the embodiment of FIG. 11 and corresponds to a sectional view taken along the line XII—XII in the next FIG. 13.
Figure 13:
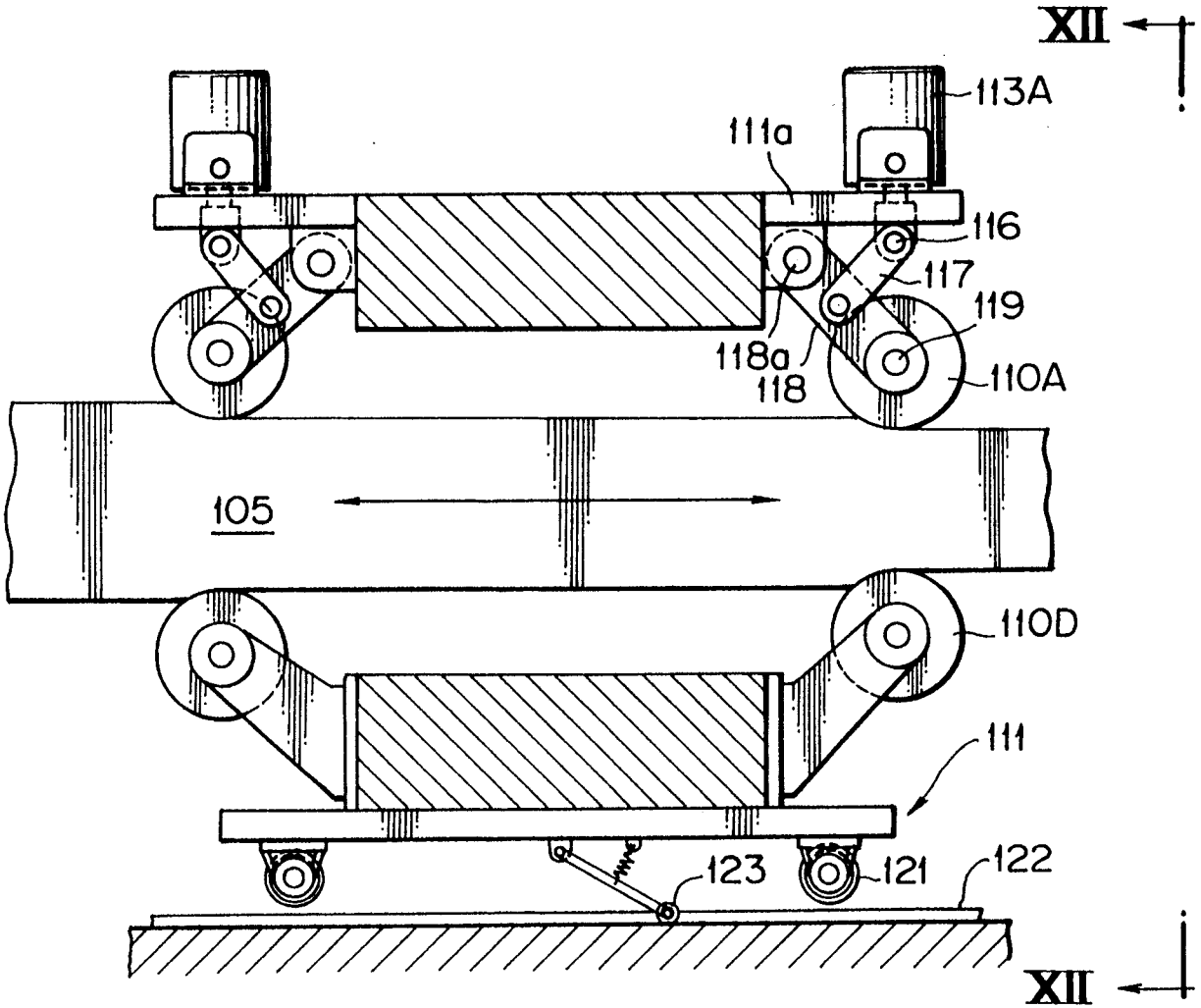
FIG. 13 is a sectional side view of the billet formation device of FIG. 12.

As shown in FIG. 12, the billet forming device 107 is composed of four billet formation rolls 110A to 110D attached to a frame **111*a* of a bogie 111 and arranged vertically and horizontally so as to entirely surround the billet 105. Two sets of these four formation rolls are arranged at the front and rear portions of the frame 111*a* as shown in FIG. 13, in which horizontal formation rolls are not shown. Further referring to FIG. 12, reference numerals 112A to 112D denote motors provided with reduction mechanisms as feed devices for the billet formation rolls and numerals 113A to 113C denote press cylinders. Press cylinders are not provided for the formation roll 110D disposed on the most lower side of the four rolls 110A to 110D. The relationship between the respective press cylinders and the billet formation rolls will be described with reference to FIGS. 12 and 13 using roll 110A** as an example.

An engaging pin 116 is inserted into a front end member 115 of a rod 114 of the press cylinder 113A. The engaging pin 116 is connected to an arm 118, pivotally on the frame **111*a* of the bogie 111, through an arm 117. The arm 118 is connected to a driving shaft 119 of the billet formation roll 110A. The relationships between the other press cylinders and the formation rolls are substantially the same as the relationship between the press cylinder 113A and the formation roll 110A**.

A geared motor 120 is disposed, as shown in FIG. 12, for moving the bogie in the casting direction at a time when the casting is not carried out. Wheels 121 are attached to the bogie 111 and a rail 122 is laid on the floor.

A position detecting device 123 is attached to the lower portion of the bogie 111, as shown in FIG. 13, as a means for correcting or amending the position of the billet formation device in the casting direction at the time of casting.

A billet manufacturing method performed using the billet forming device of the structure described above will be described hereunder.

At the start of casting, a dummy bar is set to the mold 103 and supported by the extraction device 104. Usually, the dummy bar has a section smaller than a billet. At this time, the respective press devices are released and the wheels 121 of the bogie 111 are fixed to predetermined positions on the rail 122 (i.e. approximately intermediate portions between the support rolls **106*a* and 106*b*). After the start of the casting operation, molten metal is fed from the tundish 101 to the mold 103 through the break ring 102 and is cooled from the peripheral side of the mold 103 to form a solidified shell having a predetermined thickness. The billet 105 thus molded reaches the extraction device 104 while the thickness of its solidified shell increases. Upon arriving at the extraction device 104, the billet 105 is subjected to step-wise extraction, such as "pulling→pause→puch-→back→pause" steps, and fed to the billet forming device 107 disposed on the downstream side. At this time, the press cylinder 113A is operated to separate the bogie 111 from the floor and to then start press formation while operating the press cylinders 113A to 113C. In this state, since the formation rolls 10A and 110D are connected through the frame 111***a* of the bogie 111, when the downward pressing force due to the press cylinder 113A is applied to the upper formation roll 110A, the upward pressing force is thereby applied to the lower formation roll 110D, whereby vertical pressing formation is carried out to the billet 105. At the same time, the horizontal press formation is also performed to the billet 105 by means of the press cylinders 113B and 113C.

Although the press formation of the billet is carried out in the described manner, since the respective formation rolls are provided with the driving devices 12A to 112D for the running movement thereof and the moving speeds of the formation rolls caused by the driving devices are controlled so as to be in accord with an average speed outputted from the extraction device 104, the billet forming device 107 can operate as if it is stationary. When the billet forming position of the billet forming device 107 passes over a predetermined range between the support rolls 106*a* and 106*b*, the moving speeds of the formation rolls are regulated in response to signals from the position detecting device 123 to thereby correct or adjust the positions of the formation rolls, thus making it possible to carry out the billet formation work at a constant position.

In the above embodiment, although the four billet forming rolls are disposed on four sides to entirely cover the billet, it is possible to use only two vertical forming rolls on the upper and lower sides based on the shape of the billet. Furthermore, one driving device may be substituted for four driving devices 112A to 112D.

Figure 15:
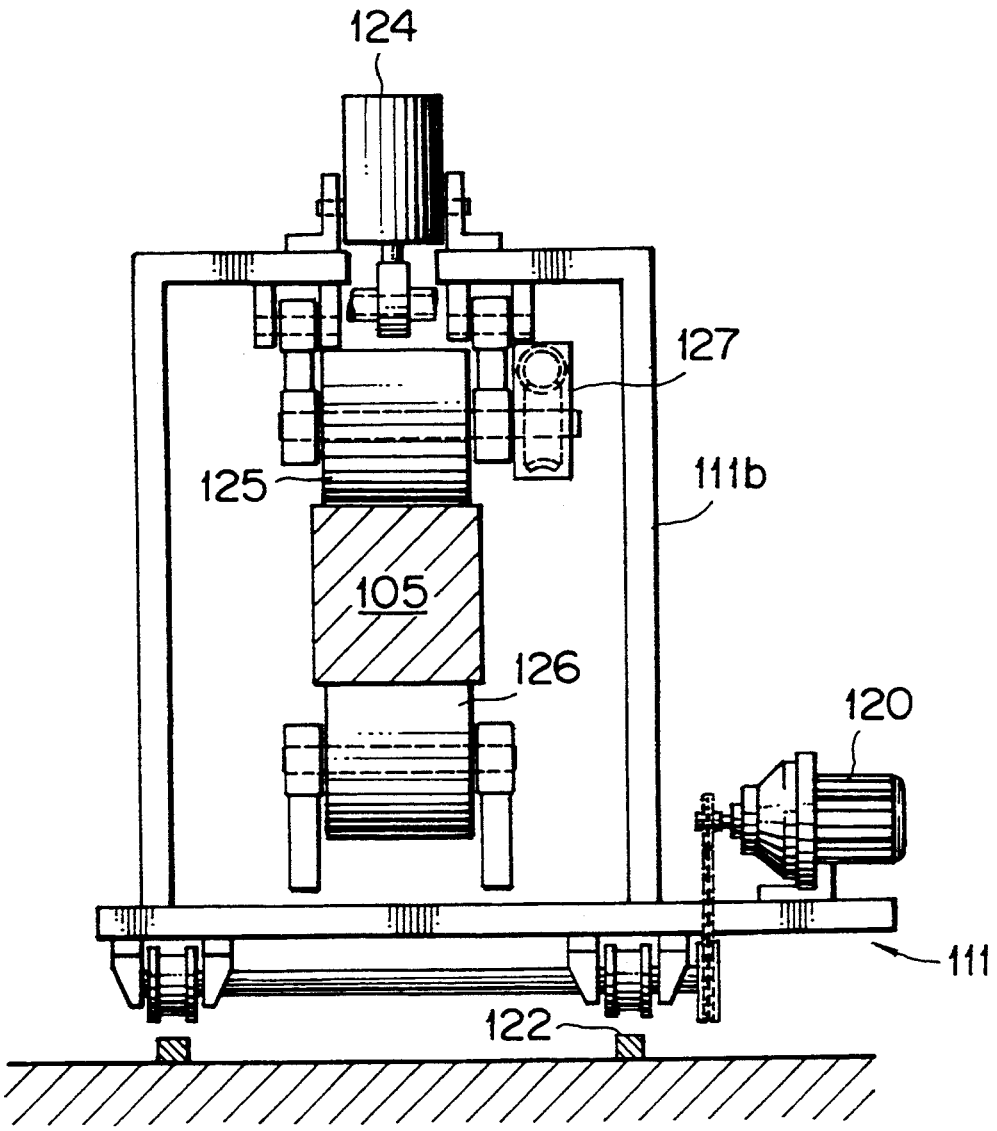
FIG. 15 is a sectional view taken along the line XV—XV in FIG. 14.
Figure 16:
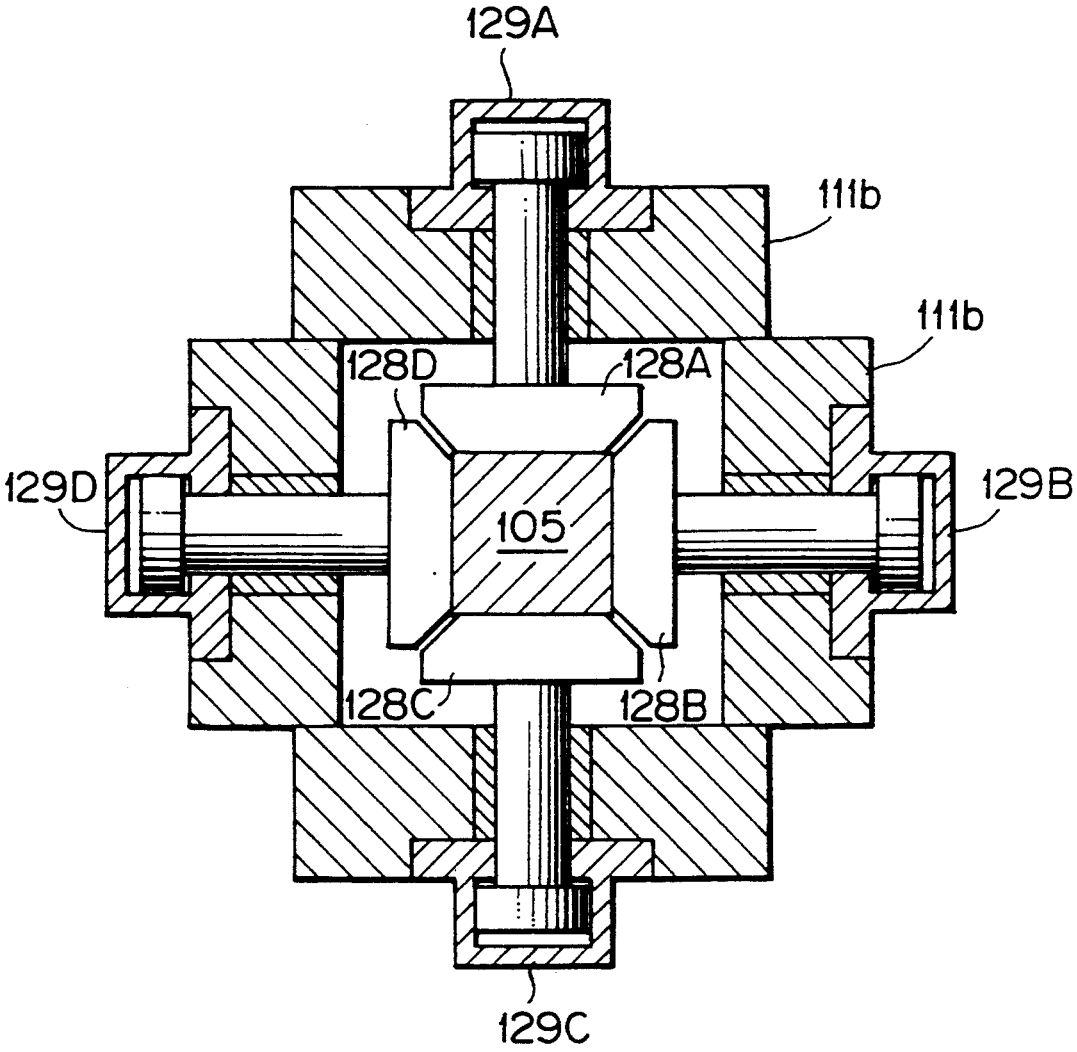
FIG. 16 is a sectional view taken along the line XVI—XVI in FIG. 14.
Figure 17:
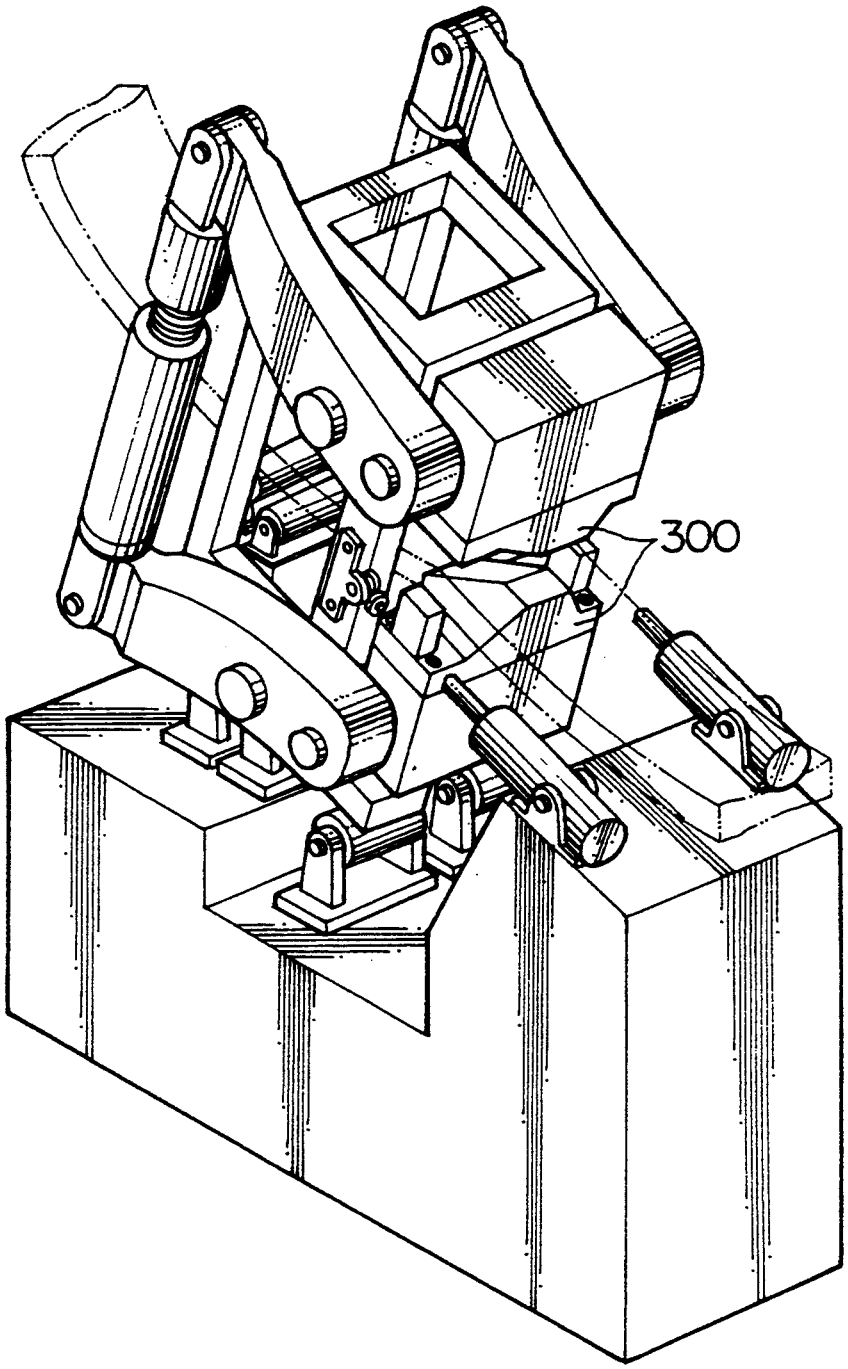
FIG. 17 PRIOR ART
FIG. 17 is a perspective view showing the outer appearance of a conventional billet formation device.

A still further embodiment according to the invention will be described hereunder with reference to FIGS. 14 to 16, in which a billet press formation device and a billet support device are separated and in which like reference numerals are used for members or portions corresponding to those of FIGS. 11 to 13.

Figure 14:
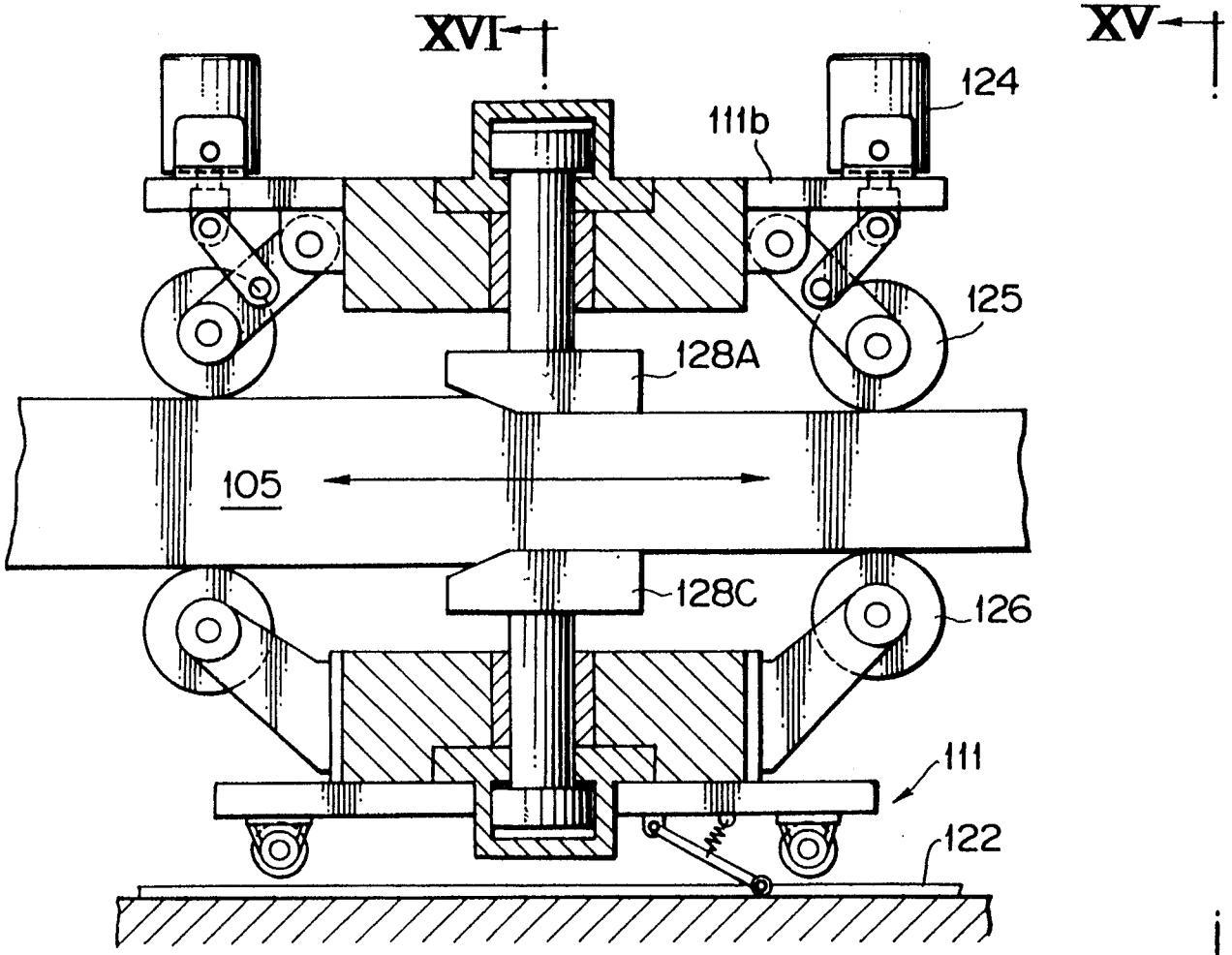
FIG. 14 is a view similar to that of FIG. 13, but related to a still further embodiment of the invention.

Referring to FIG. 14, a set of upper and lower support rolls 125 and 126 are mounted to the front and rear portions of the frame 111*b* of the bogie 111, respectively. A press cylinder 124 provided for the support roll 125 above the billet 105, but no press cylinder is provided for the lower support roll 126. As shown in FIG. 15, the upper support roll 125 is provided with a driving device such as reduction mechanism equipped motor 127, but such a driving device is not provided for the lower support roll 126. Furthermore, no support roll is disposed in the horizontal direction of the billet 105. These support rolls have the function of moving the billet while supporting the same and for maintaining the press device in the constant position against the driving reaction of the press device. In the present embodiment, press devices 128A to 128D are arranged so as to surround the four sides of the billet 105 as shown in FIG. 16. The press devices 128A to 128D are provided with press cylinders 129A to 129D, respectively.

According to the invention, formation of a large sized billet is possible in addition to the effect of the aforementioned embodiment. Because the pressing amount per one pressing operation, with respect to a certain roll diameter is limited to below a certain constant value in accordance with the physical properties of the billet. In the case of the embodiment shown in FIGS. 11 to 13, the billet can be formed only when the pressing amount is within a range possible by two-stage pressing by the formation rolls disposed to the front and rear portions of the frame of the bogie. In order to increase this pressing amount, it is necessary to enlarge the roll diameter or increase the number of pressing stages (i.e. increasing the number of forming devices). However, such methods or ways may provide problems in the amount of equipment to be mounted and an increase of cost. Accordingly, it is difficult to increase the roll diameter more than necessary and to increase the number of the forming devices. In view of this, according to the present embodiment, it is possible to carry out large pressing operation by stepwisely pressing within an allowable operation range of the forming device corresponding to the casting speed of the extraction device (that is, pressing is carried out by a plural number or times with a reduced pressing amount per one pressing operation). Moreover, since the pressing amount per one operation is small, the possibility of occurrence of inner cracks of the billet can be obviated.

It may be desired to arrange the billet forming device on the downstream side of the extraction device as shown in FIG. 1 for the reason that the variation in the casting speed in response to the variation of the billet cross section at the front and rear portions of the forming device affects the casting speed control of the extraction device less. However, in the case of a reduced pressing amount, the described defect is small, so that the billet forming device may be disposed on the upstream side of the extraction device.

What is claimed is:

1. A horizontal continuous casting apparatus, comprising:

a tundish in which a molten metal material is stored;

a mold assembly connected air-tightly to the tundish for casting an initial billet having a substantially round cross section; and an extraction means disposed on a downstream side of the mold assembly for forming a billet having a predetermined shape from the initial billet fed from the mold assembly, said extraction means comprising a plurality of formation roll means arranged along a casting direction of the initial billet, said formation roll means being composed of horizontal circular roll pairs, press means for pressing the roll pairs against the initial billet and drive means for driving the roll pairs.

2. The casting apparatus according to claim 1, wherein said mold assembly has a molding capacity for casting the initial billet and the initial billet as fed from the mold assembly is formed by the formation roll means by step-wise extracting the initial billet so as to form a billet having a predetermined thin plate-like shape.

3. The casting apparatus according to claim 2, wherein said formation roll means comprises a plurality of staged formation roll units, the formation roll units in the respective stages have horizontal circular roll pairs arranged with predetermined intervals along the casting direction of the initial billet so that a first roll is diametrically opposed to a second roll of each horizontal circular roll pair on opposite sides of the initial billet being fed such that a diameter width between each horizontal circular roll pair is narrowed as the initial billet moves in a direction towards the downstream side of the extraction means.

4. The casting apparatus according to claim 3, wherein the plural staged formation roll units comprise four staged formation roll units.

5. The casting apparatus according to claim 2, further comprising means for controlling the predetermined intervals o the horizontal circular roll pairs to be adjustable.

6. The casting apparatus according to claim 2, wherein said press means is operated so as to press the respective circular roll pairs against an outer periphery of the initial billet.

7. The casting apparatus according to claim 1, wherein said press means comprises a hydraulic cylinder assembly.

8. The casting apparatus according to claim 3, wherein the plural staged formation roll units to comprise five staged formation roll units.

9. The casting apparatus according to claim 1, wherein said drive means comprises speed reduction means operatively connected to the circular roll pairs and driving motor means operatively connected to the speed reduction means.

10. The casting apparatus according to claim 1, further comprising heating means arranged at positions corresponding to side positions of the initial billet on a diameter transverse to that pressed by the horizontal circular roll pairs.

11. The casting apparatus according to claim 10, wherein said heating means comprises a heavy oil burner.

12. The casting apparatus according to claim 10, wherein said heating means comprises an electromagnetic induction coil assembly.

13. The casting apparatus according to claim 1, wherein said horizontal circular roll pairs are arranged at portions suitable for pressing an unsolidified portion of the initial billet.

14. The casting apparatus according to claim 1, further comprising cutter means for cutting the thin plate-like billet from the extraction means so as to have a predetermined length and cooling means for cooling the cut billet.

15. A horizontal continuous casting method performed using a tundish in which a molten metal is stored and having a mold assembly air-tightly connected to the tundish, said method comprising the steps of:

feeding a molten metal to the mold assembly from the tundish;

molding a billet in the mold assembly so as to cast a billet having a substantially circular cross section; and press forming the billet drawn from the mold assembly so as to have a predetermined thin plate-like thickness, said press forming step being carried out in a plurality of stages along a billet casting direction towards a downstream side thereof.

16. The casting method according to claim 15, wherein said mold assembly has a molding capacity for casting the billet having the substantially cross circular section and the billet fed from the mold assembly is formed by a formation roll means by step-wise extracting the billet so as to change the billets to a predetermined thin plate-like shape.

17. The casting method according to claim 16, wherein said formation roll means comprises a plurality of staged formation roll units, the formation roll units in the respective stages have horizontal circular roll pairs arranged with predetermined intervals along the casting direction of the billet so that a first roll is diametrically opposed to a second roll of each horizontal circular roll pair on opposite sides of the billet being fed such that a diameter width between each horizontal circular roll pair is narrowed as the billet moves in a direction towards the downstream side of the extraction means.

18. The casting method according to claim 17, wherein the plural staged formation roll units to comprise four staged formation roll units.

19. The casting method according to claim 17, further comprising means for controlling the predetermined intervals of the horizontal circular roll pairs to be adjustable.

20. The casting method according to claim 19, wherein said press means is operated so as to press the respective circular roll pairs against an outer periphery of the billet.

21. The casting method according to claim 16, further comprising a heating step performed at positions corresponding to side positions of the billet on a diameter transverse to the diameter width pressed by the formation roll means.

22. The casting method according to claim 16, wherein the formation roll means is arranged at positions suitable for pressing an unsolidified portion of the round billet.

* * * * *